US007195603B2

(12) United States Patent
Yamazaki et al.

(10) Patent No.: US 7,195,603 B2
(45) Date of Patent: Mar. 27, 2007

(54) ULTRASONIC BEAUTY TREATMENT PROBE

(75) Inventors: Iwao Yamazaki, Tokyo (JP); Yoshihiro Izawa, Tokyo (JP)

(73) Assignee: Ya-Man Ltd., Tokyo (JP)

( * ) Notice: Subject to any disclaimer, the term of this patent is extended or adjusted under 35 U.S.C. 154(b) by 226 days.

(21) Appl. No.: 10/490,025

(22) PCT Filed: Sep. 21, 2001

(86) PCT No.: PCT/JP01/08262

§ 371 (c)(1),
(2), (4) Date: Oct. 19, 2004

(87) PCT Pub. No.: WO03/026552

PCT Pub. Date: Apr. 3, 2003

(65) Prior Publication Data

US 2005/0054957 A1 Mar. 10, 2005

(51) Int. Cl.
*A61H 1/00* (2006.01)

(52) U.S. Cl. ..... 601/2; 601/46; 601/80; 601/DIG. 15

(58) Field of Classification Search ..... 601/2, 601/15, 17, 19, 46, 80, 48, 70, 72, 73; 604/22; 600/437, 439

See application file for complete search history.

(56) References Cited

U.S. PATENT DOCUMENTS 2,283,285 A * 5/1942 Pohlman ..... 601/2
5,549,544 A * 8/1996 Young et al. ..... 601/2
5,690,608 A * 11/1997 Watanabe et al. ..... 601/19

* cited by examiner

*Primary Examiner*—Quang D. Thanh
(74) *Attorney, Agent, or Firm*—Bacon & Thomas, PLLC

(57) ABSTRACT

A supersonic beauty treatment device capable of effecting a beauty treatment for the skin and of slimming a selected portion of the body. A face beauty treatment head and body beauty treatment head are prepared, and either one is selectivley attached to the casing of the device. The casing has a tepped receptacle made on its front. Each head has a plug projecting from its base. The plug has threads fromed on its outer circumference. Thus, the head can be attached to the casing by screwing the plug in the receptacle, and two sets of switch contacts are formed on both sides of the center of the insulating bottoem of the receptacle. The electrically conductive inner circumference wall of the receptacle is grounded. The plug has a contact formed at its center, corresponding to the center contact of the receptacle. The plug has an electricaly conductive key formed on its base, corresponding to the set of switch contacts whereas the plug has an electronically conductive key formed on its base, corresponding to the set of switch contacts. Each plug has its sides grounded.

3 Claims, 5 Drawing Sheets

ULTRASONIC BEAUTY TREATMENT PROBE

TECHNICAL FIELD

The present invention relates to a supersonic beauty treatment device whose head can radiate supersonic wave for effecting a beauty treatment for the skin or for slimming the body.

BACKGROUND ART

Supersonics is sound vibrations with strong energy, and is capable of destroying germ bodies, exfoliating the superficial layer of skin, causing the cleaning effect and generating heat. Application of the supersonic wave to the face will effectively cause sterilization of the superficial layer of skin, exfoliation of waste matter and corneum, removal of pimples from the face, and removal fat or remaining cosmetic emulsion from pores of the skin. Thus, the face can be cleaned, and circulation of the blood can be expedited to activate the tissue or texture. Also, relaxation of muscles is caused, and spots, wrinkles or sags can be removed.

Application of the supersonic wave to the waste flesh of the body causes generation of heat deep under the skin to decompose the subcutaneous fat, thereby slimming the selected part of the body.

The subcutaneous fat thus decomposed can be absorbed in blood vessels or lymphatic vessels as waste.

Application of a relatively low-power, high-frequency supersonic wave to the skin will the cleaning effect on the skin. In contrast, the slimming effect is caused by the heat generated from application of the relatively high-power, low-frequency supersonic wave.

Producing the relatively low-power, high-frequency supersonic wave needs use of a relatively light, small head, and use of a high-frequency ac power supply capable of providing a reduced electric power at an increased frequency. Conversely, producing the relatively high-power, low-frequency supersonic wave needs use of a relatively heavy, large head, and use of a high-frequency ac power supply capable of providing an increased power at a reduced frequency.

To meet these requirements it is necessary that two types of supersonic beauty treatment devices, one having a large, heavy head and a low frequency-and-high power drive and the other having a small, light head and a high frequency-and-low power drive be prepared.

Supersonic beauty treatment devices have been widely used at home. From the economical point of view it is not advantageous that two different types of beauty treatment devices are prepared for home use, and it is inconvenient that such different devices be used for different purposes.

What is aimed at in the present application, therefore, is to provide a single supersonic device capable of effecting a beauty treatment for the skin and of slimming the body.

SUMMARY OF THE INVENTION

To attain this objective a supersonic beauty treatment device according to the present invention comprises: large and small heads each equipped with a supersonic vibrator, either head being detachably fixed to the casing of the device via connector means having one common interface, and being adapted to be applied to the skin; and an ac high-frequency power supply connected to the supersonic vibrator of either head for supplying it with drive power, as defined in claim 1.

In a supersonic beauty treatment device of claim 1 its connector means may have terminals to connect the supersonic vibrator to the ac high-frequency power supply, as defined in claim 2.

In a supersonic beauty treatment device of claim 1 its connector means may have a switching unit built therein for selecting a desired frequency among those provided by the ac high-frequency power supply, as defined in claim 3.

In a supersonic beauty treatment device of claim 1 its connector means may have another switching unit built therein for selecting a desired quantity of electric power among those provided by the ac high-frequency power supply, as defined in claim 4.

In a supersonic beauty treatment device of claim 1 the ac high-frequency power supply and the supersonic vibrator are built together in the connector means, as defined in claim 5.

In a supersonic beauty treatment device of claim 1 the small and large heads are allotted to face and body beauty treatments respectively, as defined in claim 6.

BRIEF DESCRIPTION OF DRAWINGS

FIG. 5A is a rear view of a head for face treatment whereas FIG. 5B is a side view of the head;

FIG. 6A is a rear view of a head for body treatment whereas FIG. 6B is a side view of the head;

DESCRIPTION OF THE PREFERRED EMBODIMENTS

The accompanying drawings show supersonic beauty treatment devices according to preferred embodiments of the present invention.

Figure 1:
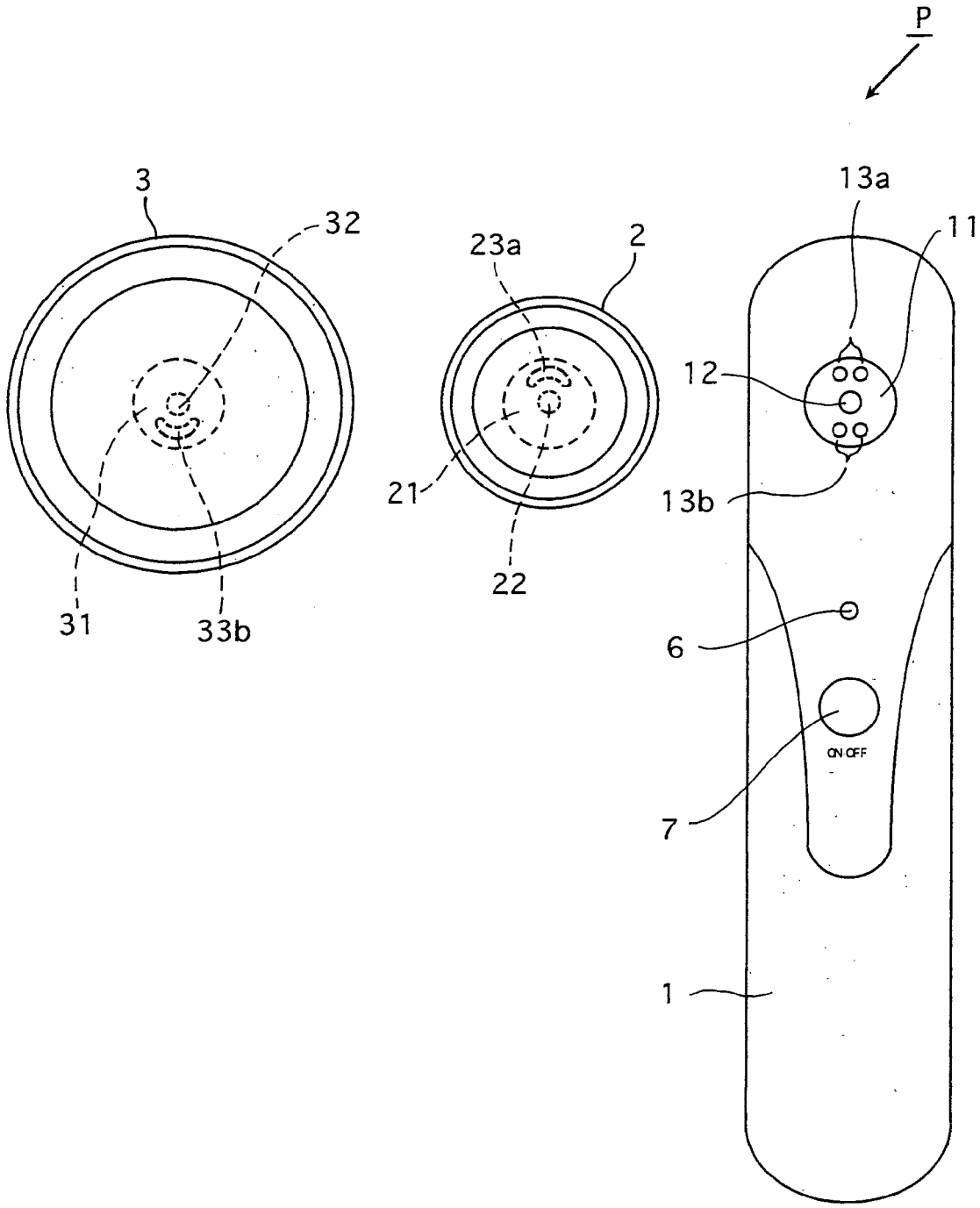
FIG. 1 is a front view showing the separate parts of a supersonic beauty treatment device according to one embodiment of the present invention.
Figure 2:
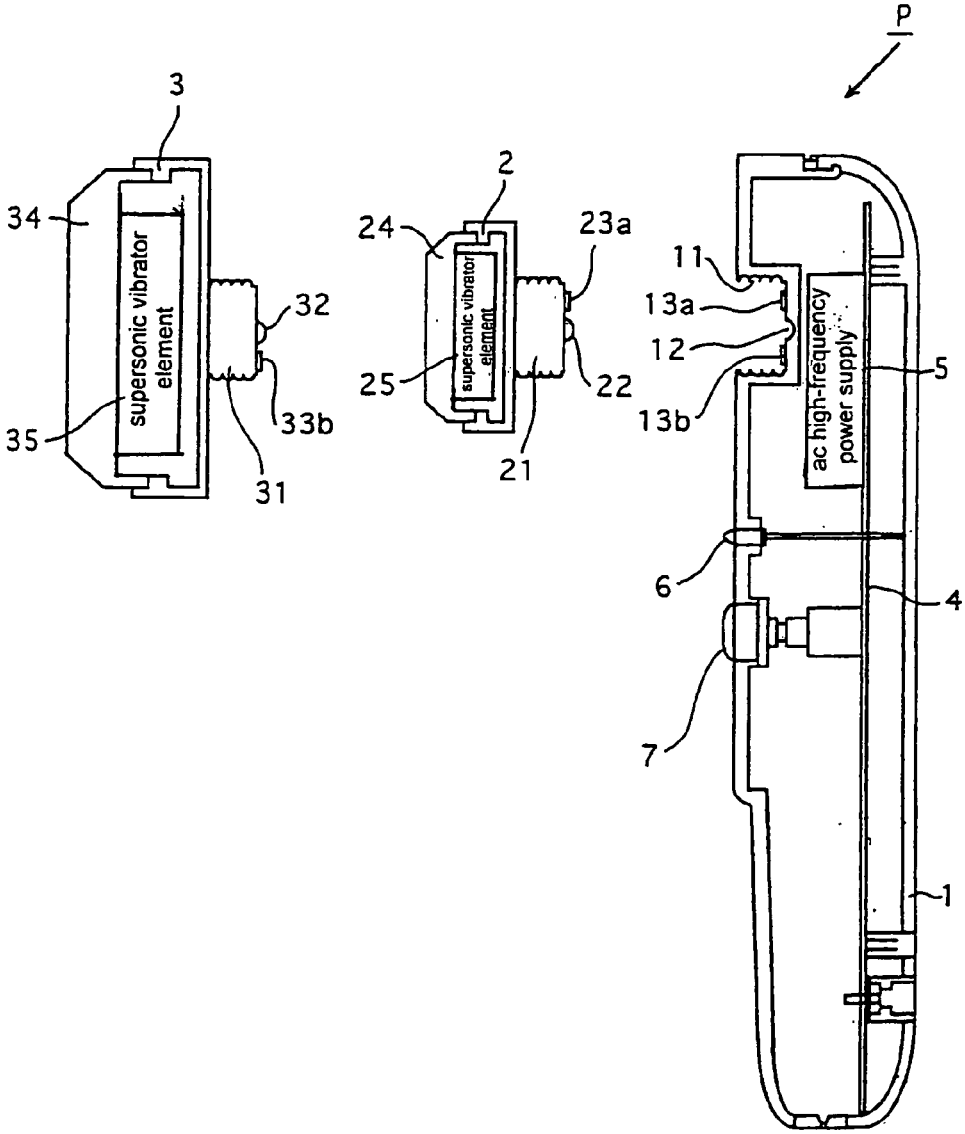
FIG. 2 is a side view showing, in cross section, the separate parts of the supersonic beauty treatment device.

FIGS. 1 and 2 show the separate parts of a supersonic beauty treatment device according to one embodiment of the present invention.

The supersonic beauty treatment device includes two heads 2 and 3 detachably attached to its casing 1, one being used in the beauty treatment for the face and the other for slimming the body.

The casing 1 has a female tapped socket 11 made on its upper, front side, and the male plug 21 or 31 of either head 2 or 3 has threads on its circumference to mate with the female tapped socket.

Otherwise, the male plug 21 or 31 may be so sized and shaped that it may be press-fitted in the female socket 11 rather than threadedly engaged with the tapped socket.

The socket 11 has a center contact 12 on its insulating bottom, and two sets of switch contacts 13*a* and 13*b* are arranged diametrically symmetrical with respect to the center contact 12.

The circular wall of the socket 11 is electrically conductive, and is grounded.

The male plug 21 or 31 has a convex contact 22 or 32 at the center of its insulating top, corresponding to the concave contact 12 of the socket 11. Also, a key 23*a* is formed on the plug 21 as a counter part to the set of switch contacts 13*a* of the socket 11, and a key 33*b* is formed on the plug 31 as a counter part to the set of switch contacts 13*b* of the socket 11. The plug 21 or 31 when mated with the socket 11 can be grounded as its conductive circumference is put in contact with the circular wall of the socket 11.

The set of switch contacts 13*a* or 13*b* can be closed or opened by putting the keys 23*a* or 33*b* on or apart from the set of switch contacts 13*a* or 13*b*. The set of switch contacts 13*a* or 13*b* may be of the stationary type or of the depressible type, which is responsive to insertion of the male plug for depressing and turning on.

The casing 1 has an ac high-frequency power supply 5, an LED lamp 6 and a push switch 7 mounted on its substrate 4.

The LED lamp 6 and the push switch 7 appear in the openings made on the front side of the casing 1.

The LED lamp 6 turns on when the power supply is put in circuit, and it turns off when the power supply is disconnected from the circuit.

The push switch 7 performs the "on" and "off" control of the power supply as follows: the first push of the push switch 7 will put the high-frequency power supply 5 in operation, and the second push will put it in inoperative condition, thus providing no voltage at its output terminal.

The high-frequency power supply 5 may be equipped with a timer for setting a predetermined length of time for treatment.

The head 2 or 3 is like a circular cylinder in appearance. The circular cylinder has a cap-like vibrator 24, 34 applied to its front top. A supersonic vibrator element 25, 35 such as a piezoelectric element or ceramics is fixed to the rear side of the cap 24, 34.

The head 2 or 3 is made of a soft, electrically insulating material such as a synthetic resin, permitting the vibrator 24, 34 to vibrate freely.

The vibrator 24, 34 is a thin sheet of flexible metal such as copper, stainless steel, or light, hard metal such as aluminum, titanium, or duralumin, which metal sheet is hard chrome plated. The vibrator 24 of the head 2 for face treatment is relatively small whereas the vibrator 34 of the head 3 for body treatment is relatively large.

Figure 3:
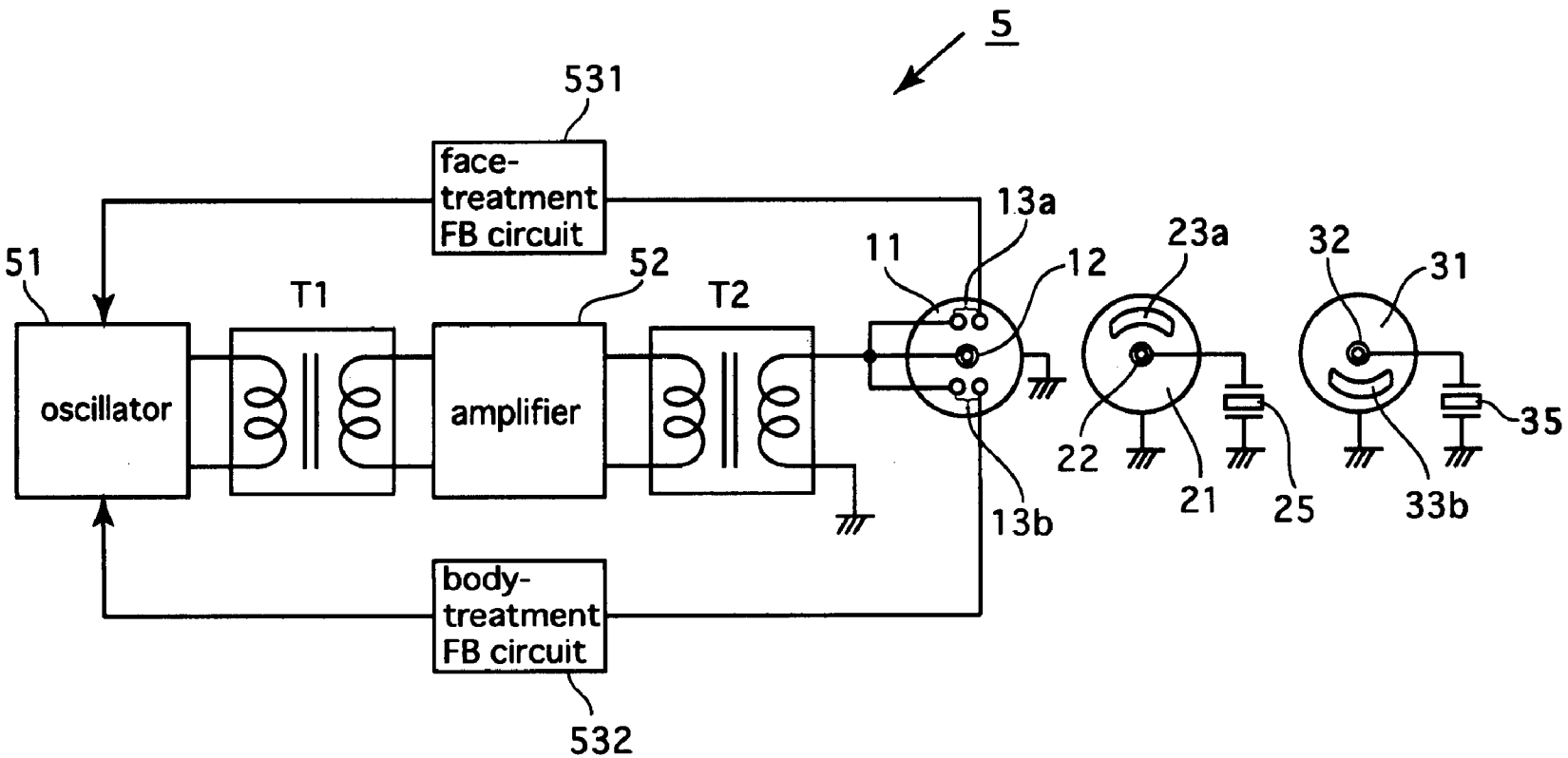
FIG. 3 is a block diagram of an ac high-frequency transformer.
Figure 4:
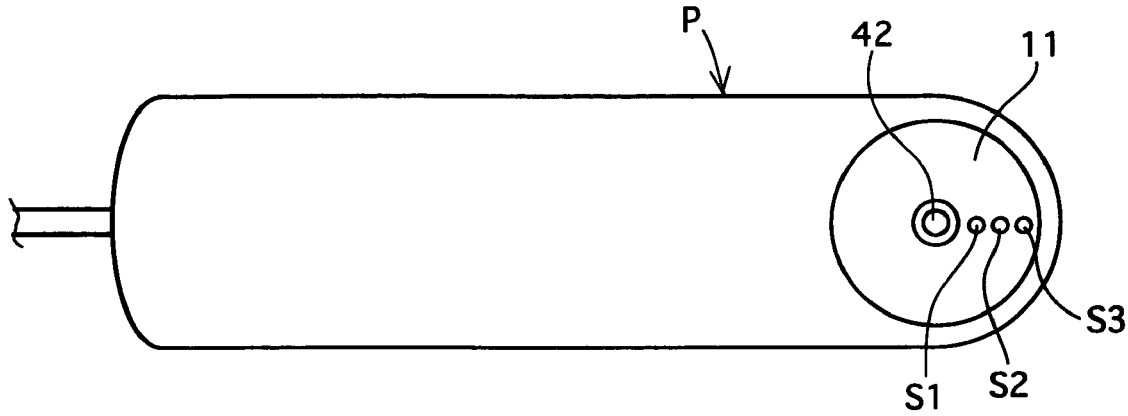
FIG. 4 is a front view of a supersonic beauty treatment device according to another embodiment of the present invention.
Figure 5:
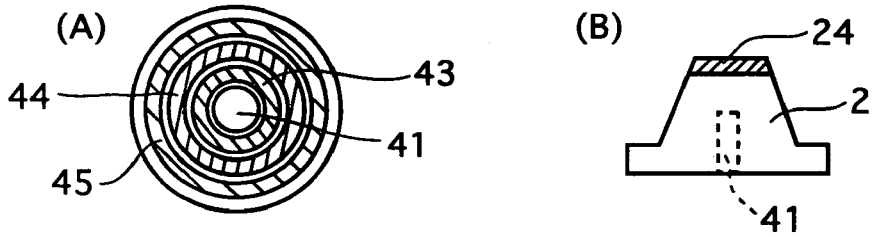
Figure 6:
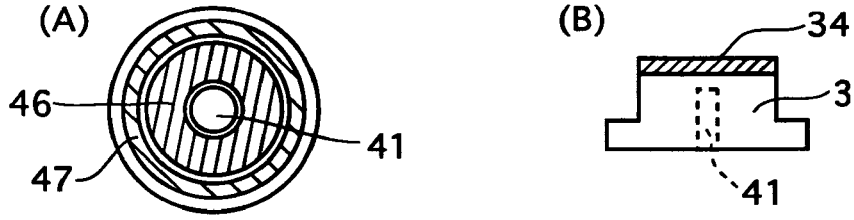

FIG. 3 shows a wiring diagram of a high-frequency ac power supply used in a supersonic beauty treatment device according to one embodiment of the present invention.

The high-frequency power supply 5 comprises an oscillator 51, a coupling transformer T1 whose primary winding is connected to the oscillator 51, an amplifier 52 connected to the secondary winding of the coupling transformer T1, and an output transformer T2 whose primary winding is connected to the amplifier 52.

One terminal of the secondary winding of the output transformer T2 is connected to the center terminal 2 of the socket 11, and to one of the switch contacts 13*a* of one set and one of the switch contact 13*b* of the other set, and the other terminal of the secondary winding of the output transformer T2 is grounded.

The other switch contacts 13*a* and 13*b* are connected to a face-treatment feed-back circuit 531 and to a body-treatment feed-back circuit 532.

Alternatively two high-frequency power supplies 5 of different frequencies and oscillation powers may be prepared for effecting a beauty treatment for the face and for slimming the body, and these power supplies may be built in the heads 2 and 3. In this case the switching contacts 13*a* and 13*b* can be omitted.

One terminal of the supersonic vibrator element 25 in the face beauty treatment head 2 is connected to the center contact 22 of the plug 21, and the other terminal of the supersonic vibrator element 25 is grounded.

When the plug 21 is inserted in the receptacle 11, the electrically conductive key 23*a* of the plug 21 is laid across the set of switch contacts 13*a* to permit electric current to flow therebetween.

One terminal of the supersonic vibrator element 35 in the body beauty treatment head 3 is connected to the center contact 32 of the plug 31, and the other terminal of the supersonic vibrator element 35 is grounded.

When the plug 31 is inserted in the receptacle 11, the electrically conductive key 33*b* of the plug 31 is laid across the switch contacts 13*b* to permit electric current to flow therebetween.

The supersonic beauty treatment device of FIGS. 1 to 3 is constructed as described above. In effecting a required beauty treatment for the skin, first, the plug 21 of the face beauty treatment head 2 is screwed into the receptacle 11. When the head 2 is fastened to the casing 1 of the device, the supersonic vibrator element 25 of the head 2 is connected to the high-frequency ac power supply 5.

Then, the face treatment feed-back circuit 531 is connected between the power transformer T2 and the oscillator 51 via the closed switching contacts 13*a*.

A certain medium such as cream or emulsion is applied to a selected skin area to be treated or to the head 2, thereby increasing the supersonic transmission efficiency, and then, the push switch 7 is depressed to make the power supply turn on.

The ac voltage of high frequency is applied to the supersonic vibrator element 25 to cause the bending deformation of the vibrator element 24 to produce the supersonic vibration.

The face treatment feed-back circuit 531 causes the oscillator 51 to oscillate at the same high-frequency as the supersonic vibrator element 25, thus feeding back the supersonic vibrator element 25 with the oscillating power of a relatively low level, at which the drive circuit is set for the face beauty treatment.

When the supersonic oscillation starts, the head 2 is lightly applied to the skin at right angles, and it is slowly moved to draw circles on the face.

Thus, the skin is patted by supersonic vibration to raise and remove fat, waste matter or remaining cosmetic emulsion from the pores, exfoliate the old superficial skin layer, and remove corneum and pimples from the face without danger and pain.

Extensive distribution of supersonic vibration on the face effectively expedites circulation of the blood, thereby activating the tissue or texture. Also, relaxation of muscles is caused, and spots, wrinkles or sags can be removed.

In effecting the slimming treatment on the body, first, the plug 31 of the body treatment head 3 is screwed into the socket 11. When the head 3 is fastened to the casing 1 of the device, the supersonic vibrator element 35 of the head 3 is connected to the high-frequency ac power supply 5.

Then, the body treatment feed-back circuit 532 is connected between the power transformer T2 and the oscillator 51 via the closed switching contacts 13*b*.

A certain medium such as cream or emulsion is applied to a selected body area to be treated or the head 3, thereby increasing the supersonic transmission efficiency.

Then, the push switch 7 is depressed to make the power supply 5 turn on. The ac voltage of high frequency is applied to the supersonic vibrator element 35 to cause the bending deformation of the vibrator element 35 to produce the supersonic vibration.

The body treatment feed-back circuit 532 causes the oscillator 51 to oscillate at the same low-frequency as the supersonic vibrator element 35, thus feeding back the supersonic vibrator element 35 with the oscillating power of a relatively high level, at which the drive circuit is set for the body beauty treatment.

When the supersonic oscillation starts, the head 3 is lightly applied to the skin at right angles, and it is slowly moved to draw circles on the skin.

Thus, the skin is patted by supersonic vibration to generate heat deeply under the skin, thereby decomposing and removing the subcutaneous fat.

FIGS. 4 to 8 show a supersonic beauty treatment device according to another embodiment of the present invention.

In this particular embodiment the face or body beauty treatment head 2 or 3 has a tapped hole 41 made on its rear side, and a socket 11 has a stud 42 standing at its center. The head 2 or 3 can be fixed to the body of the device by screwing the stud 42 into the tapped hole 41 of the head 2 or 3.

The face beauty treatment head 2 has three concentric electrode rings 43, 44 and 45 formed on its rear side. The body beauty treatment head 3 has two concentric electrode rings 46 and 47 formed on its rear side.

The size of the inner ring 46 of the body beauty treatment head 3 is equal to the total size of the innermost and intermediate rings 43 and 44 of the face beauty treatment head 2, and the diameter of the outer ring 47 of the head 3 is equal to that of the outermost ring 45 of the head 2.

The socket 11 has three contacts S1, S2 and S3 formed at different radial distances on its bottom, so that the electrode rings 43 to 45, or 46 and 47 of the head 2 or 3 may be put on these contacts S1, S2 and S3 when the head 2 or 3 is screwed in the receptacle 11.

Figure 7:
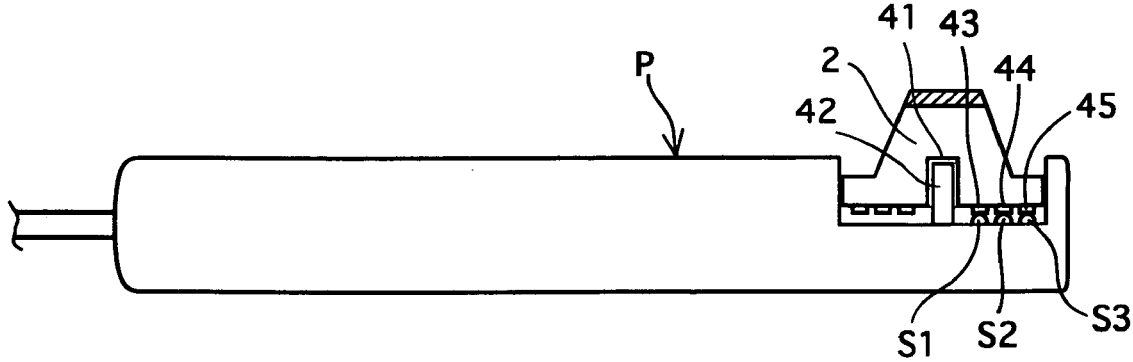
FIG. 7 is a side view of the supersonic beauty treatment device of FIG. 4 with the face treatment head of FIG. 5 attached thereto.

In case that the face beauty treatment head 2 is fastened to the body of the device, the electrode rings 43, 44 and 45 are put on the contacts S1, S2 an S3, as seen from FIG. 7. In case that the body beauty treatment head 3 is fastened to the body of the device, the wide electrode ring 46 is put on the contacts S1 and S2, and the narrow electrode ring 47 is put on the contact S3 (drawings omitted).

Figure 8:
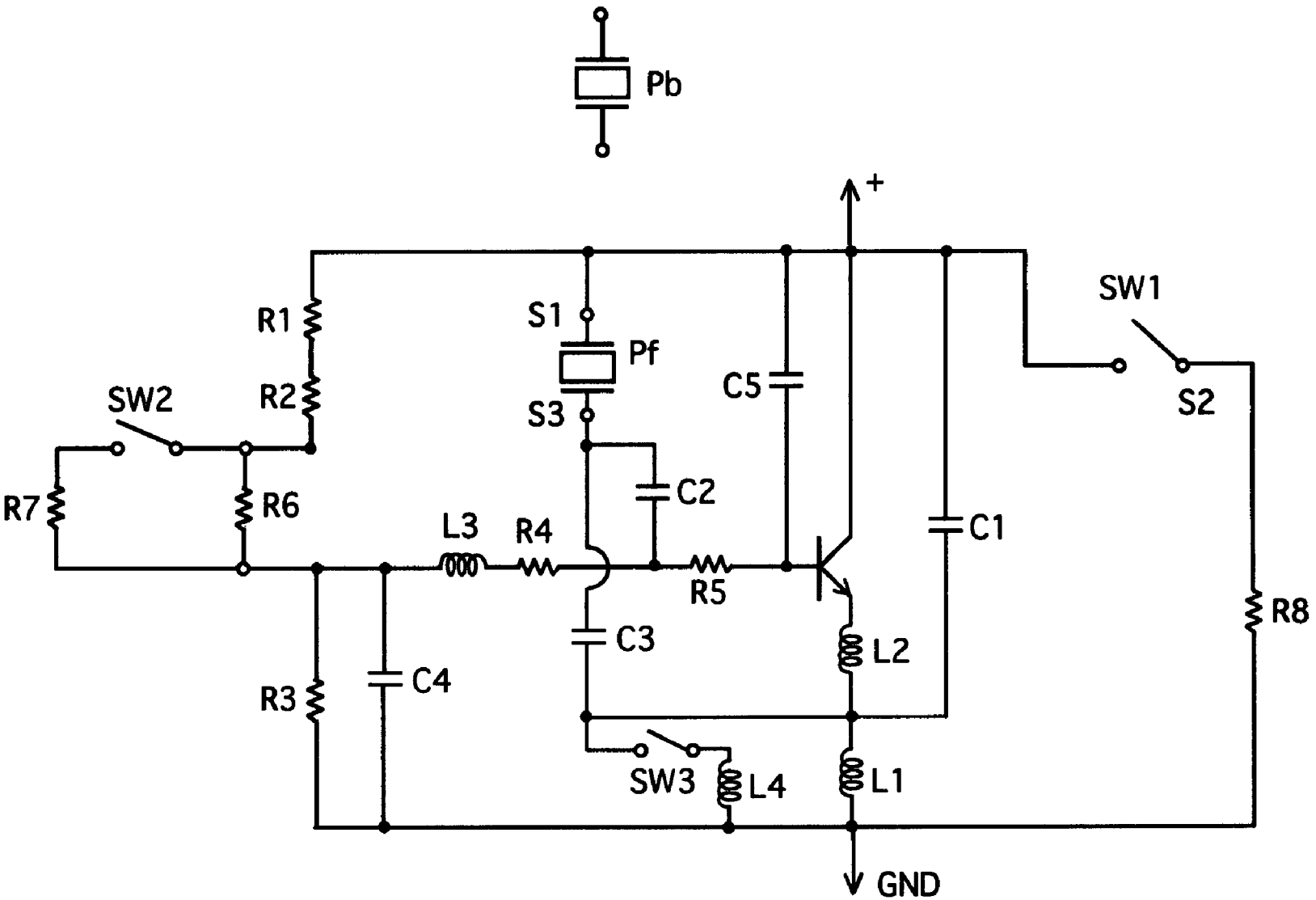
FIG. 8 is a block diagram of an ac high-frequency transformer built in the supersonic beauty treatment of FIG. 4.

FIG. 8 shows a wiring diagram of a drive circuit for driving the supersonic vibrator element of the head 2 or 3. The drive circuit is installed in the supersonic beauty treatment device. The supersonic vibrator element such as a piezoelectric element Pf is connected between the contacts S1 and S3 via the electrode rings.

When the face beauty treatment head 2 is used, the switches SW1, SW2 and SW3 are opened to provide the piezoelectric element Pf with a relatively high-frequency, low-electric power for vibration.

When the body beauty treatment head 3 is used, the wide electrode ring 46 is put on the contacts S1 and S2 to close the switch SW1, and then the other switches SW2 and SW3 are closed together.

The switch SW1 can make a decision as to which type of head is used, the face beauty treatment head or the body beauty treatment head.

The closure of the switch SW1 causes the voltage appearing between the contacts S1 and S3 to lower in frequency, so that a relatively low-frequency, high-electric power may be applied to the piezoelectric element Pf of the body beauty treatment head 3 for vibration.

The switch SW2 is used for controlling the gain of the drive circuit whereas the switch SW3 is used for controlling the frequency of the drive circuit.

In the embodiment of FIGS. 4 to 8 the face and body beauty treatment heads 2 and 3 can have one and same drive circuit in common. The drive circuit is responsive to attachment of which type of head 2 or 3 for driving its supersonic vibrator at low or high frequency.

As may be understood from the above, a supersonic beauty treatment device according to the present invention is equipped with a connector functioning as a common interface for attaching large and small heads to the body of the device.

The vibrating energy can be automatically controlled in respect of frequency and power to meet the type of beauty treatment simply by selecting and attaching the head to the body of the device. Thus, the range of supersonic beauty treatment is expanded.

The invention claimed is:

1. A supersonic beauty treatment device, comprising:

a casing having a socket and being equipped with an AC high-frequency power supply which enables selecting a set of oscillating frequency and power;

a large head having a plug, which is detachably fixed to said socket, and a supersonic vibrator that oscillates by low-frequency and large power; and a small head having a plug, which is detachably fixed to said socket, and a supersonic vibrator that oscillates by high-frequency and small power, wherein:

each of said plugs has electrically conductive electrodes, and said socket has sets of contacts which are unique to said electrodes of each plug and are closed or opened by said electrodes; and either of said heads is installed with said casing for electrically connecting said AC high-frequency power supply to said respective supersonic vibrator, whereby switching the set of oscillating frequency and power of said AC high-frequency power supply with closing or opening one set of said contacts by said electrodes in each plug provides the large head with low-frequency and large power and the small head with high-frequency and small power.

2. The supersonic beauty treatment device according to claim 1, wherein:

said contacts are a center contact formed on the bottom of said socket and two sets of switch contacts being arranged diametrically symmetrical with respect to said center contact, and the electrodes are an electrically conductive key formed on each plug of the large and small heads as a counter part to one and the other set of the switch contacts.

3. A supersonic beauty treatment device according to claim 1 wherein: said contacts are three contacts formed at different radial distances and said electrodes are either two or three circumference electrode rings which put on said contacts when either of said heads is installed to said casing.

* * * * *